United States Patent [19]

Mackie et al.

[11] Patent Number: 4,502,918

[45] Date of Patent: Mar. 5, 1985

[54] TWO-STAGE CHEMICAL TREATMENT OF MECHANICAL WOOD PULP WITH SODIUM SULFITE

[75] Inventors: David M. Mackie; Peter Joyce, both of Vancouver, Canada

[73] Assignee: MacMillan Bloedel Limited, Vancouver, Canada

[21] Appl. No.: 385,286

[22] Filed: Jun. 4, 1982

Related U.S. Application Data

[63] Continuation-in-part of Ser. No. 272,400, Jun. 10, 1981, abandoned.

[51] Int. Cl.[3] ..... D21C 3/04; D21C 3/26

[52] U.S. Cl. ..... 162/24; 162/28; 162/55; 162/84; 162/149

[58] Field of Search ..... 162/24, 25, 26, 28, 162/55, 149, 141, 83, 84

[56] References Cited

U.S. PATENT DOCUMENTS

| | | | |
|---|---|---|---|
| 3,597,310 | 8/1971 | Sumi . | |
| 3,607,613 | 9/1971 | Uschmann . | |
| 4,145,246 | 3/1979 | Goheen et al. . | |
| 4,259,148 | 3/1981 | Beath et al. | 162/24 |

FOREIGN PATENT DOCUMENTS

| | | | |
|---|---|---|---|
| 1071805 | 9/1980 | Canada | 162/24 |
| 0827656 | 5/1981 | U.S.S.R. . | |

OTHER PUBLICATIONS

Beath et al., "Refiner Mechanical Pulping of Chemically Pretreated Wood", *TAPPI,* Dec. 1977, vol. 60, No. 12, pp. 77–81.

A. C. Shaw, "The Opco Process Applied to TMP Screened Rejects", Jan. 28 & 29, 1982.

Gavelin, "A Single TMP Furnish—The Monopulp Process", *Pulp & Paper International,* 22, 54–56, (Dec. 1980).

Barnet, A. J., Leask, R. A. and Shaw, A. C., "The Opco Process", (presented at CPPA Meeting, Jan. 30, 1980), Ontario Paper Company, Ltd.

Barnet, A. J., Leask, R. A. and Shaw, A. C., "The Opco Process", *Pulp and Paper Canada,* 81, T255–T260, (1980).

Dahm, H. P., "Chemimechanical Pulp From Spruce", *Paperi ja Puu,* 48, 591–594, (1966).

Jackson, M. and Williams, G., "Factors Limiting the Strength Characteristics of Thermomechanical Pulp", *Pulp and Paper Canada,* 81, TR65–72, (1980).

Kvisgaard, H. J., "Postsulfonation", *Norsk Skogind.,* 19, 155–63, (1965) (translation).

Lindholm, C. and Gummerus, M., "Modification of Groundwood Pulp Through Chemical Treatment of the Coarse Fiber Fraction", *Paperi ja Puu,* 60, 653–664, (1978).

Tsukamoto, H., Takahashi, Y., and Koide, K., "Effect of Sulfite Treatment on Mechanical Pulp", ESPRA Invited Papers, Spring Meeting, (Mobile, Alabama), Apr. 3–5, 1978.

*Primary Examiner*—Steve Alvo

*Attorney, Agent, or Firm*—Banner, Birch, McKie & Beckett

[57] ABSTRACT

A two-stage chemical treatment process is disclosed for increasing the density, strength and brightness properties of mechanical wood pulp. The method comprises the steps of: applying an aqueous solution of sodium sulfite in the range of about 1%–10% sodium sulfite based on bone dry weight of wood to wood particles, the solution having a pH in the range of about 4.5–11; heating the sodium sulfite treated wood particles to a temperature in the range of about 100°–160° C. and maintaining the particles in the temperature range for a period of time in the range of about 20 seconds to 10 minutes; refining the heated sodium sulfite treated wood particles into mechanical wood pulp; separating the pulp into a reject fraction and an accept fraction, the reject fraction containing a higher proportion of shives and long fiber material; applying an aqueous solution of sodium sulfite, in the range of about 4%–50% sodium sulfite based on bone dry weight of wood, to the reject fraction, the solution having a pH in the range of about 4.5–11; cooking the sodium sulfite treated reject fraction at a temperature in the range of about 100°–160° C. for a period of time in the range of about 2–120 minutes; refining the cooked sodium sulfite treated reject fraction; and recombining at least part of the refined reject fraction with at least part of the accept fraction.

26 Claims, No Drawings

TWO-STAGE CHEMICAL TREATMENT OF MECHANICAL WOOD PULP WITH SODIUM SULFITE

This is a continuation-in-part of application Ser. No. 272,400, filed June 10, 1981, now abandoned.

The present invention relates to mechanical wood pulp. More specifically, the present invention relates to a two-stage chemical treatment process for increasing the density, strength and brightness properties of mechanical wood pulp.

There are two basic types of wood pulp, mechanical pulp, where the wood is mechanically defibrated, that is reduced to fibrous form, and chemical pulp, where wood chips are chemically treated to achieve defibration. Mechanical pulps have a high yield and are cheaper to produce than chemical pulps, but chemical pulp is considered a higher grade of pulp. In the past it has been the practice to mix a certain quantity of chemical pulp with mechanical pulp to produce a satisfactory furnish for such products as newsprint paper.

In the manufacture of mechanical wood pulp with disc refiners, wood particles in the form of wood chips, shredded wood chips, sawdust, or the like, are fed between one or more pairs of counter-rotating discs and thereby defibered or reduced to fibrous form. If the disc refiner is open discharge, that is open to the atmosphere, the product is referred to as "refiner mechanical pulp" (RMP). If the refiner is pressurized and the refining process carried out at temperatures above 100° C., the product is referred to as "thermomechanical pulp" (TMP). The present invention is applicable to both RMP and TMP and these pulps are referred to throughout the specification collectively as refiner pulps, or mechanical refiner wood pulps.

Refiner pulps, when compared to chemical pulps, are deficient in density, brightness, drainage rate and strength. Furthermore, refiner pulps contain higher levels of shives or fiber bundles than chemical pulps. It has been the aim for many years to improve the properties of refiner pulps. If refiner pulps can be improved to such an extent that chemical pulps need not be added, then a newsprint furnish may be made from a single component pulp, that is to say a furnish which is 100% refiner pulp and not a mixture of pulps.

Density is a particularly important property of newsprint. If the density of the paper sheet is low then linting and other printing problems occur. Furthermore, low density paper gives less yardage on a paper roll which is made to a constant diameter. The tendency towards linting is also increased by the presence of shives of fiber bundles in the sheet.

Brightness is also an important newsprint property. In the paper industry in North America today, older and poorer quality wood is being cut to produce pulp because the better wood sites have been cleared and second growth wood in the cleared sites is not yet ready for cutting. The wood now being cut tends to contain a higher percentage of rot which particularly affects brightness in the resulting paper. Therefore, there is a need today to improve the brightness of paper.

Drainage rate refers to the ease with which water can be removed from the pulp slurry on the paper machine. The drainage rate determines how fast the paper machine can run and is characterized by the drainage time or, more commonly, by the freeness. The freeness of a given pulp is inversely related to the paper sheet density and strength. With progressive refining the density and strength increase while the freeness decreases due to the fibrillation of fibers and the creation of small fibrous fragments or fines. The freeness must be maintained above a certain level to allow the paper machine to be operated efficiently. This places a constraint on the amount of refining energy which can be applied to a pulp, and therefore on the density and strength which can be developed.

It is known that the properties of refiner pulps can be improved by mild chemical treatment, particularly treatment with sodium sulfite. Such pulps are commonly referred to as "chemimechanical pulps". Treatment of wood chips with sodium sulfite prior to refining is disclosed in U.S. Pat. Nos. 4,116,758 and 4,259,148 while treatment of the refined pulp is disclosed in Canadian Pat. No 1,071,805. In co-pending application, Ser. No. 272,291 filed June 10, 1981 in the names of Mackie and Jackson a method of treating the long fiber reject fraction of a mechanical pulp with sodium sulfite is disclosed. Treatment of this long fiber reject fraction reduces the number of shives and makes the remaining shives particularly susceptible to being broken up in the reject refining step. The treatment also develops some flexibility in the long fibers which may reduce the energy requirement for refining the long fiber fraction, or may produce a mechanical pulp with increased tensile strength.

The term "long fiber fraction" is a recognized prior art term generally employed to designate that fraction of the pulp which is retained on a 48 mesh screen of Bauer-McNett classification. The long fiber fraction also includes all the fraction that is retained on screens larger than 48 mesh.

It is generally understood that the improvement in properties of refiner pulps gained by sodium sulfite treatment is due at least in part to a chemical reaction between the sulfite and the wood lignin which results in a certain level of sulfonate bound to the wood fibers, and which in turn increases the flexibility and bonding power of the fibers. It is further understood from the prior art that such sodium sulfite treatment may be applied to wood chips or the like prior to initial refining, or may be applied to the pulp or fractions of the pulp after the initial refining. However, it has nowhere been suggested that combining a sulfite pretreatment of the wood chips with a subsequent sulfite post-treatment of all or part of the refined pulp would have any particularly beneficial effect. Indeed, it might well be supposed that if the wood chips or other starting material had already been treated with sodium sulfite there could scarcely be any further benefit in treating the pulp again with the same chemical.

We have now found, surprisingly, that a two-stage process, consisting of pretreatment of wood particles with sodium sulfite prior to initial refining followed by sodium sulfite post-treatment of the long fiber fraction of the pulp, offers several important advantages. The sulfite pretreatment increases the fraction of long fibers in the initially refined pulp, which gives added potential for strength development. However, the long fiber fraction of the initially refined pulp has a lower sulfonate content than the accept fraction and fines fraction, thus sodium sulfite treatment of the long fiber fraction increases the sulfonate content of the fraction.

It is known that paper sheet density can be increased by either pretreatment of wood particles with sodium sulfite prior to initial refining, or treatment of the long fiber fraction with sodium sulfite after refining. However, combination of the two treatments, as in the present two-stage process, results, surprisingly, in a larger increase in sheet density than would have been expected from the magnitude of the increase achieved by the two treatments when applied separately.

The two-stage process produces pulps with improved brightness properties. Nevertheless the pulps may be further brightened by subsequent treatment with brightening agents such as sodium hydrosulfite or hydrogen peroxide.

The two-stage process enables pulps to be produced at yields of at least 90% based on the dry weight of the wood particles, which pulps provide high quality newsprint furnish without the addition of a chemical pulp.

The fraction of long fibers produced in the first stage and the degree of flexibility imparted to the long fibers in the second stage can be varied at will by adjusting the chemical treatment conditions and the refining conditions. Screening conditions can also be varied to alter the proportions of accept fractions and long fiber fractions. This can be achieved because the screen is not a perfect fractionator as defined in our definition of long fiber fraction. There will always be some smaller fibers present in the long fiber fraction.

Furthermore long fiber fractions and accept fractions can be combined in desired portions to produce a newsprint furnish with the desired properties. This provides a new, powerful and unique means for producing different grades of newsprint without having to add chemical pulp.

The improvement in strength obtained by the combination of the sodium sulfite pretreatment of the wood particles followed by the sodium sulfite treatment of the long fiber fraction does not result in any substantial loss in freeness or drainage rate. Thus, one has the option to apply less refining energy to produce a pulp with strength properties substantially the same to that which would be obtained without the sodium sulfite treatment. Furthermore such a pulp has a substantially higher freeness which may be desirable for the efficient operation of a paper machine. The sulfite pretreatment together with the lower input of refining energy produces a pulp with a higher proportion of long fiber fraction.

The term "newsprint furnish" refers to the mixture of pulps which are fed to a paper mill for production of newsprint. The newsprint furnish has drainage properties to allow efficient operation of a high speed paper machine at operating speeds above 2000 feet per minute, and more commonly in the range of 3000–4000 ft/min at the same time having the required sheet density, opacity and printability qualities recognized throughout the industry. Newsprint furnishes vary depending upon the species of woods and on the requirements of different types of paper mills. The sheet caliper of the resulting paper at 48.8 g/m$^2$ basis weight is preferably in the range of about 78–81 microns, and a pulp TAPPI handsheet density in the range of about 0.375–0.42 g/cm$^3$.

The present invention provides a method of improving the properties of mechanical refiner wood pulp, comprising the steps of: applying an aqueous solution of sodium sulfite, in the range of about 1%–10% sodium sulfite based on bone dry weight of wood, to wood particles, the solution having a pH in the range of about 4.5–11; heating the sodium sulfite treated wood particles to a temperature in the range of about 100°–160° C. and maintaining the particles in the temperature range for a period of time in the range of about 20 seconds to 10 minutes; refining the heated sodium sulfite treated wood particles into mechanical wood pulp; separating the pulp into a long fiber fraction and an accept fraction, the long fiber fraction containing a higher proportion of shives and long fiber material; applying an aqueous solution of sodium sulfite, in the range of about 4%–50% sodium sulfite based on bone dry weight of wood, to the long fiber fraction, the solution having a pH in the range of about 4.5–11; cooking the sodium sulfite treated long fiber fraction at a temperature in the range of about 100°–160° C. for a period of time in the range of about 2–120 minutes; refining the cooked sodium sulfite treated long fiber fraction; and recombining at least part of the refined long fiber fraction with at least part of the accept fraction.

In a preferred embodiment the present invention provides a method of improving the properties of mechanical refiner wood pulp, comprising the steps of:

applying an aqueous solution of sodium sulfite in the range of about 3%–7% sodium sulfite based on bone dry weight of wood, to wood particles, the solution having a pH in the range of about 5.5–9.5;

heating the sodium sulfite treated wood particles to a temperature in the range of about 115°–155° C. and maintaining the particles in the temperature range for a period of time in the range of about 2–4 minutes;

refining the heated sodium sulfite treated wood particles into mechanical wood pulp;

separating the pulp into a long fiber fraction and an accept fraction, the long fiber fraction containing a higher proportion of shives and long fiber material;

applying an aqueous solution of sodium sulfite in the range of about 8%–18% sodium sulfite based on bone dry weight of wood, to the long fiber fraction, the solution having a pH in the range of about 5.5–9.5;

cooking the sodium sulfite treated long fiber fraction at a temperature in the range of about 130°–155° C. for a period of time in the range of about 2–30 minutes;

refining the cooked sodium sulfite treated long fiber fraction; and recombining at least part of the refined long fiber fraction with at least part of the accept fraction.

The wood particles may be wood chips, shredded wood chips, shavings, sawdust, or the like. In a preferred embodiment the wood particles have a moisture content in the range of about 25%–60%. In one embodiment the wood particles are first squeezed to reduce moisture content in a screw press, preferably to a moisture content in the range of about 25%–50%, followed by application of the aqueous solution of sodium sulfite.

In one embodiment the long fiber fraction represents about 10%–65% and preferably about 10%–35% by weight of the whole mechanical refiner wood pulp. In another embodiment the yield of the wood particles after being treated with sodium sulfite and prior to being refined is at least about 91% based on bone dry weight of wood particles, and the overall yield of the mechanical refiner wood pulp is at least about 90% based on bone dry weight of wood particles.

In another embodiment, sufficient aqueous solution of sodium sulfite is applied to the wood particles to provide a liquid/wood ratio in the range of about 1/1 to 3/1, with a preferred range of about 2/1 to 3/1. The pulp consistency of the long fiber fraction is preferably in the range of about 10%–50% prior to application of the aqueous solution of sodium sulfite.

In yet another embodiment, in a further step where a refiner wood pulp is made by applying at least 3% sodium sulfite to the wood particles, sodium hydrosulfite may be applied to the recombined mechanical refiner wood pulp prior to the pulp being processed into a paper. The resulting paper has improved brightness properties.

In the process of the present invention, wood particles in the form of wood chips, shredded wood chips, shavings, sawdust or the like, are pretreated with a sodium sulfite solution. An aqueous solution of sodium sulfite is applied to wood particles, preferably by spraying or in some cases by immersion of the wood particles in the solution. The concentration of the solution is such that the amount of sodium sulfite applied to the wood particles is in the range of about 1%–10% based on the bone dry weight of wood. A preferred range is about 3%–7%. The concentration of the solution is therefore determined taking into account the quantity of sodium sulfite to be deposited on the wood particles. In most cases the wood particles are chips, although shredded wood chips, shavings and sawdust may all be used. The sodium sulfite solution has a pH in the range of about 4.5–11, preferably about 5.5–9.5, and the resulting liquid/wood ratio after the application of sodium sulfite solution is in the range of about 1/1 to 3/1, preferably about 2/1 to 3/1. The yield of the wood particles after the pretreatment should preferably be not less than 91% based on the bone dry weight of wood particles.

The present invention also provides a long fiber fraction of a mechanical refiner wood pulp made by the process of refining heated sodium sulfite treated wood particles to a wood pulp, separating the long fiber fraction from the wood pulp, cooking the long fiber fraction in a second sodium sulfite treatment and further refining the long fiber fraction such that properties of TAPPI handsheets made from the long fiber fraction have a freeness in the range of about 100–300 ml, sheet density in the range of about 0.4–0.55 g/cm$^3$, burst index in the range of about 3.2–4.6 g/cm$^3$, breaking length in the range of about 6500–7800 m and tear index in the range of about 4–14 mN.m$^2$/g.

In a preferred embodiment, the long fiber fraction represents about 10%–65% of the wood pulp. There is also provided in the present invention, a mechanical refiner wood pulp suitable for use as a newsprint furnish without the addition of a chemical pulp, made by the process of refining heated sodium sulfite treated wood particles to a wood pulp, separating the wood pulp into a long fiber fraction and an accept fraction, cooking the long fiber fraction in a second sodium sulfite treatment, further refining the long fiber fraction, and combining the further refined long fiber fraction in the desired proportions to produce a newsprint furnish with the desired properties.

In further embodiments, the yield of the newsprint furnish is at least about 90% based on bone dry weight of the wood particles. The accept fraction has a freeness in the range of about 65–130 ml and the quantity of the accept fraction combined with the long fiber fraction to produce the newsprint furnish is in the range of about 50%–85% by weight of the combined pulp. TAPPI handsheets made from the newsprint furnish of the present invention is preferably on the range of about 0.375–0.42 g/cm$^3$.

The moisture content of wood chips immediately before application of the sodium sulfite solution is preferably in the range of 25%–60%. Higher moisture contents require more concentrated solutions of sodium sulfite as less liquid can be absorbed by the wood particles. In the case of spraying, all the sodium sulfite solution applied to the wood particles should preferably remain on the wood.

After the application of the sodium sulfite solution, the chips are heated either in a steaming tube or in a pressure vessel, such as a digester, at a temperature in the range of about 100°–160° C., and preferably about 115°–155° C. In the case of the steaming tube, the wood chips generally remain in the tube for a period of time in the range of about 20 seconds to 4 minutes and are maintained within the temperature range. In the case of the digester or other type of pressure vessel, the period of time that the wood chips are maintained within the temperature range is generally in the order of about 1–10 minutes.

If the wood particles have a high moisture content, then they may first be squeezed in a press, such as a Pressafiner screw press, so that moisture is squeezed from the wood particles together with some air and organic materials such as wood acids and colored extracts. The resulting moisture content of the wood particles is generally within the range of about 25%–50%. Immediately after the chips leave the Pressafiner, they may be sprayed or flooded with the sodium sulfite solution and may then be fed by means of a screw conveyor into a steaming tube, digester or the like. After the compression step in the Pressafiner, the wood particles act as a sponge and absorb liquid so after spraying with sodium sulfite the resulting product may have a moisture content up as high as 65%–70%. Moisture contents higher than this can cause problems in the steaming and refining stages. On the whole, although sawdust may be used in the preparation of wood pulp, it generally does not make such a good product as chips or shredded chips because there are less long fibers in sawdust.

Whenever sodium sulfite is referred to throughout the specification, this includes sodium sulfite, any mixture of sodium sulfite and sodium bisulfite, or sodium bisulfite. The proportion of sulfite to bisulfite depends on the pH of the solution. At pH 4.5, there is 100% sodium bisulfite present. Below this pH the solution tends to evolve free sulfur dioxide, causing environmental problems. There are also corrosion problems at low pH values and for this reason it is preferred not to operate the process below pH 5.5. At pH 9.5, there is 100% sodium sulfite present. Above this pH there may be some loss in pulp brightness and yield, which loss becomes severe above pH 11. A pH of 11 is therefore considered to be about the upper pH limit for the process when using softwood chips.

The sulfur bound to the reject fraction of the pulp after treating the reject fraction with sodium sulfite is believed to be present in the form of sulfonate and results are accordingly calculated as percent sulfonate by multiplying the measured percent sulfur contents by 2.5.

Separation of the long fiber fraction is conveniently carried out using one or more screens, such as a Centrisorter which is a pressure screen. These screens are used in the production of mechanical pulps to remove shives or fiber bundles which cause linting and runnability problems in the paper sheet. The screen divides the pulp into a long fiber or reject fraction and an accept fraction. The proportion of long fiber fraction may be varied by changing the size of holes or slots in the screen, the pressure differential across the screen, or the consistency of the pulp. In most refiner pulps, the long fiber fraction is typically 10%–35% by weight of the whole pulp. However, the present invention defines long fiber fraction as that portion which is retained on a 48 mesh screen and this can be increased to about 65% of the whole pulp by varying the screening operation. In this case probably as much as 10% of the long fiber fraction would be less than the screen size but would stay with the long fiber fraction.

It has been found that pretreatment of the wood particles prior to refining increases the proportion of long fibers in the resulting pulp. This is a potentially important feature of the process since long fibers when rendered flexible by further sulfite treatment, contribute substantially to sheet strength.

In the sodium sulfite treatment of wood particles, it has been found that sulfite does not act on all the fibrous elements in the wood to the same extent. More specifically, it has been found that where conditions are adjusted to retain the pulp yield above 91%, the longer fiber material is sulfonated to a lesser degree than is the shorter material. In most species of wood, the sulfonate content of the long fibers in the long fiber fraction is about one-half the sulfonate content of a refiner pulp which has been pretreated with sodium sulfite. Subsequent sulfite treatment of the long fibers in the long fiber fraction increases the sulfonate content of these long fibers.

The degree of sulfite treatment in the pretreatment and post-treatment stages is important. More severe sulfite treatment, including higher pH ranges, prolonged cooking times, and higher temperatures than defined in the present invention, may well result in improved strength properties and higher pulp densities, but will also result in severe yield loss, lower brightness and other undesirable features.

By varing the sodium sulfite treatment of the wood particles, and the refining energy, the long fiber fraction can be varied in the range of about 10%–50% by weight of the whole pulp. If the long fiber fraction is 65% of the pulp, there is a greater improvement in final sheet density and caliper, at probably lower overall energy usage but higher chemical requirements.

In post-treatment of the long fiber fraction, the fraction is generally first passed through a press to reduce moisture content, then sodium sulfite in an aqueous solution is applied to the long fiber fraction so that a range of about 4%–50% of sodium sulfite is applied to the pulp and preferably about 8%–18%. The pulp is preferably at a consistency of about 10%–50% and the pH of the sodium sulfite solution is in the range of about 4.5–11, preferably in the range of about 5.5–9.5. In a preferred embodiment, the sodium sulfite treated long fiber fraction is cooked in a digester at a temperature in the range of about 130°–150° C. for a period of time in the range of about 2–30 minutes. However, it is satisfactory if the temperature range is in the order of 100°–160° C. and the period of time is in the order of 2–120 minutes.

After cooking, the sodium sulfite treated long fiber fraction is passed through a press to reduce liquid content and then refined in a reject refiner, generally a disc refiner. The refining step requires less energy than required for the untreated long fiber fraction to produce the required degree of freeness or strength because the treated long fibers have become more flexible. The refined long fiber fraction is screened and rejects, which may amount to as much as 10% by weight of the fraction, can be recycled into the fraction leaving the digester.

The long fiber fraction pulp is passed to a pulp storage tank, and the accept fraction pulp is stored in a separate storage tank. The newsprint furnish for a particular paper machine is prepared by combining accept fraction and long fiber fraction in the desired proportions, dependent on newsprint requirements and on newsprint mill operation. For example, two machines in a mill have different proportions of accept fraction and long fiber fraction so that all the fractions are used up. If insufficient long fiber fraction is available, then one or more machines could be run with the addition of a small quantity of chemical pulp. The accept fraction combined with the long fiber fraction is preferably in the range of about 50%–75% by weight of the recombined pulp.

The typical freeness range of the accept fraction for a newsprint is about 65–130 ml Csf. The desired parameters of the long fiber fraction after chemical treatment and refining are in the range of about 100–300 ml Csf with a debris level up to about 1%. Properties of TAPPI handsheets made from the long fiber fraction have a density in the range of about 0.4–0.55 g/cm$^3$, burst index in the range of about 3.2–4.6 kPa.m$^2$/g, breaking length in the range of about 6500–7800 m and tear index in the range of about 8–14 mN.m$^2$/g.

Density of the TAPPI handsheets is lower than density of the paper sheets produced on a paper mill. The density of the handsheet is measured by a typical standard, but small variations in densities of the handsheets can occur and yet the newsprint furnish still meets the specification for a paper machine. The thickness of the resulting paper sheet is an important parameter, referred to as caliper specification, which can still be kept within desirable limits despite these handsheet density variations. If, however, the density figures are outside a preset range for a particular paper machine, the caliper specification cannot be met, and loss of sheet strength or other problems can occur in attempts to meet these caliper specifications.

The overall yield of the recombined pulp, utilizing all the accept and long fiber fraction, is not less than 90% based on the bone dry weight of the wood particles. In one embodiment, the sulfonate content of the recombined pulp is not less than about 0.6% and preferably not less than about 0.8% based on the bone dry weight of the pulp, the desirable lower limit of sulfonate content depending to some extent on the species of wood being pulped. These sulfonate content figures apply to North American west coast species such as hemlock, balsam fir and spruce.

The properties of the treated long fiber fraction are complimentary to those of the accept fraction. Thus, the long fiber fraction exhibits high density, high strength and high freeness while the accept fraction is characterized by high opacity, high brightness and good printability. Accordingly, it is possible to vary the grade of paper made by varying the proportion of long fiber fraction recombined with the accept fraction.

It is sometimes necessary to improve the brightness of the paper sheet and this may be achieved by application of brightening agents to the pulp prior to being formed into paper on the paper machine. The two-stage sulfite treatment process itself results in a substantial increase in pulp brightness but this brightened pulp nevertheless remains responsive to further brightening on treatment with agents such as sodium hydrosulfite or hydrogen peroxide. It has been found that the brightness gain obtained by hydrosulfite treatment on the recombined pulp of the present invention is about the same as it is for untreated refiner pulps.

EXAMPLE 1

Softwood chips with approximately 50% moisture content were treated in a steaming tube for 2 minutes at 130° C. and then refined in a pressurized disc refiner followed by an open discharge disc refiner.

EXAMPLE 2

Softwood chips with approximately 50% moisture content were passed through a Pressafiner and on emerging were sprayed with sodium sulfite solution having a pH of 6 to give 5% sodium sulfite applied to the wood. The treated wood chips were steamed in a steaming tube for 2 minutes at 130° C. and then refined in a pressurized disc refiner followed by an open discharge disc refiner.

EXAMPLE 3

Softwood chips with approximately 50% moisture content were passed through a Pressafiner and on emerging were sprayed with sodium sulfite solution having a pH of 6 to give 5% sodium sulfite applied to the wood. The treated wood chips were steamed in a steaming tube for 2 minutes at 130° C. and then refined in a pressurized disc refiner followed by an open discharge disc refiner. The resulting pulp was screened with a Centrisorter to give a long fiber fraction of 15%. The long fiber fraction was further refined and recombined with screen accept fraction.

EXAMPLE 4

Softwood chips with approximately 50% moisture content were passed through a Pressafiner and on emerging were sprayed with sodium sulfite solution having a pH of 6 to give 5% sodium sulfite applied to the wood. The treated wood chips were steamed in a steaming tube for 2 minutes at 130° C. and then refined in a pressurized disc refiner followed by an open discharge disc refiner. The resulting pulp was screened with a Centrisorter to give a long fiber fraction of 15%. The long fiber fraction was gien a further treatment with a sodium sulfite solution having a pH of 9.5 sprayed onto the long fiber fraction such that 12% sodium sulfite was applied to the long fiber fraction. The treated long fiber fraction was cooked at 145° C. for 20 minutes. The long fiber fraction was then further refined and recombined with the screen accept fraction.

Properties of TAPPI handsheets formed from recombined whole pulps for Examples 1 to 4 are shown in Table I.

TABLE I

| | No Sodium Sulfite Treatment | Sodium Sulfite Pretreatment Long Fiber Fraction | | |
|---|---|---|---|---|
| | | Not Treated | Refined | Sulfonated & Refined |
| Example No. | 1 | 2 | 3 | 4 |
| Sulfonate, % | — | 0.95 | 0.91 | 1.01 |
| Yield, % | 97 | 96 | 96 | 96 |
| Refining Energy kWh/t | 2240 | 1912 | 1883 | 1825 |
| Freeness, ml | 99 | 159 | 163 | 160 |
| Drainage Time, sec | 19 | 7.2 | 8.5 | 9.2 |
| Density, g/cm$^3$ | 0.346 | 0.305 | 0.300 | 0.333 |
| Burst Index, kPa · m$^2$/g | 1.77 | 1.59 | 1.53 | 1.93 |

TABLE I-continued

| | No Sodium Sulfite Treatment | Sodium Sulfite Pretreatment Long Fiber Fraction | | |
|---|---|---|---|---|
| | | Not Treated | Refined | Sulfonated & Refined |
| Breaking Length, m | 3590 | 3640 | 3220 | 3860 |
| Tear Index, mN · m$^2$ · g | 10.0 | 9.1 | 9.6 | 9.8 |
| Brightness, % | 49 | 55 | 56 | 55 |

Comparing the results shown in Table I, the sodium sulfite treated pulps of Examples 2 and 4 were all refined to a Canadian standard freeness (Csf) of about 160 ml. At this level of freeness the sodium sulfite treated pulps had strength properties roughly equivalent to those of the typical commercial refiner pulp of Example 1 which had a Csf of 99 ml. All of sulfite treatments applied gave substantial improvement in brightness and freeness compared to a typical commercial refiner pulp of the same strength.

In the examples shown in Table I, the long fiber fraction represented 15% of the total pulp. The accept fraction had a particularly low density, and since the density of the TAPPI handsheets are determined by the algebraic sum of the furnish components, i.e.

sheet density = y by accept fraction density + x by long fiber fraction density, where y = percent of accept fraction and x = percent of long fiber fraction, the density of the accept fraction had an overriding effect on the final sheet density.

TABLE II

| | No Sulfite Treatment | Sulfite Pretreatment Long Fiber Fraction Sulfonated & Refined |
|---|---|---|
| Sample | — | 4 |
| Freeness, ml | 113 | 122 |
| Drainage Time, sec | 21.8 | 23.3 |
| Elementary Properties: | | |
| Basis Weight, g/m$^2$ | 59.2 | 59.0 |
| Caliper, microns | 161 | 142 |
| Density, g/cm$^3$ | 0.368 | 0.416 |
| Optical Properties: | | |
| Brightness, % | 39.6 | 47.8 |
| Opacity, % | 98.5 | 94.6 |
| Scattering Coeff, cm$^2$/g | 591 | 515 |
| Absorption Coeff, cm$^2$/g | 132 | 66 |

Table II illustrates a more typical comparison of density made between a commercial refiner pulp and a combined pulp of the present invention.

EXAMPLE 5

Softwood chips with approximately 52% moisture content were treated in a steaming tube for 2 minutes at 130° C. and refined in a pressurized disc refiner followed by an open discharge refiner. The resulting pulp was screened with a Hooper pressure screen to give a long fiber fraction of 40% which was then refined to various freeness levels covering the range 100–200 ml Csf.

EXAMPLE 6

Softwood chips with approximately 52% moisture content were passed through a Pressafiner and on emerging were immersed in a solution of sodium sulfite having a pH of about 11 to give 7.8% sodium sulfite applied to the wood. The treated wood chips were steamed in a steaming tube for 2 minutes at 130° C. and then refined in a pressurized disc refiner followed by an open discharge refiner. The resulting pulp was screened with a Hooper pressure screen to give a long fiber fraction of 32%. The long fiber fraction was further refined in a reject refiner to various levels covering the range 100–200 ml Csf.

EXAMPLE 7

Softwood chips with approximately 52% moisture content were treated in a steaming tube for 2 minutes at 130° C. and refined in a pressurized disc refiner followed by an open discharge refiner. The resulting pulp was screened with a Hoooper pressure screen to give a long fiber fraction of 40%. The long fiber fraction was treated with sodium sulfite solution having a pH of 9.5 sprayed onto the long fiber fraction such that 12% sodium sulfite was applied to the long fiber fraction. The long fiber fraction was cooked at 145° C. for 20 minutes and then refined in a reject refiner to various levels coverng the range 100–200 ml Csf.

EXAMPLE 8

Softwood chips with approximately 52% moisture content were passed through a Pressafiner and on emerging were immersed in a solution of sodium sulfite having a pH of about 11 to give 7.8% sodium sulfite applied to the wood. The treated wood chips were steamed in a steaming tube for 2 minutes at 130° C. and then refined in a pressurized disc refiner followed by an open discharge refiner. The resulting pulp was screened with a Hoooper pressure screen to give a long fiber fraction of 32%. The long fiber fraction was given a further treatment with sodium sulfite solution having a pH of 9.5 sprayed onto the long fiber fraction such that 12% sodium sulfite was applied to the long fiber fraction. The long fiber fraction was cooked at 145° C. for 20 minutes and then refined in a reject refiner to various levels covering the range 100–200 ml Csf.

Paper handsheets were prepared according to TAPPI official test method T205 om-81 from the variously processed long fiber fractions of Examples 5 to 8, in order to assess the effect of the treatments on sheet density. The handsheets were tested in accordance with TAPPI official standard T220 os-71. The long fiber fractions were chosen for this study because the long fibers contained in the long fiber fractions are known to be the primary source of low density problems in refiner pulps and also because using only the long fiber fraction greatly simplifies the comparison of sheet density among pulps at a constant freeness.

The results are shown in Table III, which lists the various paper sheet densities interpolated to freeness levels of 100, 150 and 200 ml Csf. The figures in parentheses in Table III show the increase in sheet density relative to the density exhibited by the chemically untreated rejects of Example 5. The figures show an increase in density of about 6% attributable to the sulfite pretreatment of the chips (Example 6) and about 14% attributable to sulfite post-treatment of the long fiber fraction (Example 7). However, when the pretreatment and post-treatment processes are combined as in Example 8 the increase in density is about 27% which is substantially higher than the sum of the increases obtained in the individual treatments.

TABLE III

| | Paper Sheet Density, g/cm$^3$ | | | |
|---|---|---|---|---|
| Example No. | 5 | 6 | 7 | 8 |
| Long Fiber Fraction, % | 40 | 32 | 40 | 32 |
| Sulfite Treatment | — | Chips | Rejects | Chips + Rejects |
| Csf, ml 100 | 0.377 | 0.404 (7) | 0.432 (15) | 0.477 (27) |
| 150 | 0.347 | 0.369 (6) | 0.396 (14) | 0.444 (28) |
| 200 | 0.328 | 0.345 (5) | 0.374 (14) | 0.418 (27) |

EXAMPLE 9

Tests were carried out to determine the additive effect of brightening with sodium hydrosulfite on refiner pulps made with varying percentage levels of sodium sulfite applied to wood chips. Softwood chips were treated with 3% and 7% sodium sulfite, the solution being at pH 6 in both cases. The treated chips were heated to 135° C. and maintained at that temperature for 2 minutes and then refined in a pressurized disc refiner followed by an open discharge refiner. The resulting pulp was treated with 1% sodium hydrosulfite at a pulp consistency of 4% for 60 minutes at 50° C. The results are shown in Table IV together with corresponding data for the refiner pulp made without sulfite treatment of the wood chips. The results show that over the range studied, hydrosulfite treatment gives approximately 6 percentage points increase in brightness irrespective of the brightness already imparted by the initial sulfite treatment of the wood chips. Even in the case of 7% sodium sulfite to the wood chips there is 11% increase in brightness and a further 5% increase is still achieved by the hydrosulfite treatment.

TABLE IV

| | Percent $Na_2SO_3$ Applied to Chips | | |
|---|---|---|---|
| Brightness, % Elrepho: | 0 | 3 | 7 |
| Initial pulps | 44.1 | 51.9 | 55.1 |
| Gain due to sodium sulfite | — | 7.8 | 11.0 |
| Treated with 1% sodium hydrosulfite | 50.0 | 59.0 | 60.2 |
| Gain due to sodium hydrosulfite | 5.9 | 7.1 | 5.1 |
| Total gain over untreated wood chips | 5.9 | 14.9 | 16.1 |

EXAMPLE 10

Softwood chips with approximately 52% moisture content were passed through a Pressafiner and on emerging were immersed in a solution of sodium sulfite having a pH of about 11 to give 7.8% sodium sulfite applied to the wood. The treated chips were steamed in a steaming tube for 2 minutes at 130° C. and then refined in a pressurized disc refiner followed by an open discharge refiner. The resulting pulp was screened with a Hooper pressure screen to give a long fiber fraction of 32%. The long fiber fraction was given a further treatment with sodium sulfite solution having a pH of 9.5 sprayed onto the long fiber fraction such that 12% sodium sulfite was applied to the long fiber fraction. The long fiber fraction was cooked at 145° C. for 20 minutes, refined to 177 ml Csf and recombined with the accept fraction. Properties of the recombined whole pulp are shown in Table V and compared to the corresponding properties of a typical commercial newsprint furnish consisting of 53% groundwood, 25% TMP and 22% semibleached kraft chemical fiber. At approximately the same level of freeness, the density and strength properties of the pulp produced by the present two-stage process are superior to those of the commercial furnish.

TABLE V

| | Two-Stage Process Pulp | Commercial Newsprint Furnish |
|---|---|---|
| Csf, ml | 130 | 136 |
| Density, g/cm$^3$ | 0.386 | 0.378 |
| Breaking Length, m | 4170 | 3505 |
| Burst Index, kPa · m$^2$/g | 2.07 | 1.99 |
| Tensile Energy Absorption Index, mJ/g | 510 | 507 |

The embodiments of the invention in which an exclusive property or privilege is claimed are defined as follows:

1. A method of improving the properties of mechanical refiner wood pulp, comprising the steps of:
   applying an aqueous solution of sodium sulfite, in the range of about 1%–10% sodium sulfite based on bone dry weight of wood, to wood particles, selected from the group consisting of wood chips, shredded wood chips, and shavings, the solution having a pH in the range of about 4.5–11;
   heating the sodium sulfite treated wood particles to a temperature in the range of about 100°–160° C. and maintaining the particles in the temperature range for a period of time in the range of about 20 seconds to 10 minutes;
   refining the heated sodium sulfite treated wood particles into mechanical wood pulp;
   separating the pulp into a long fiber fraction and an accept fraction, the long fiber fraction containing a higher proportion of shives and long fiber material, said long fiber fraction representing about 10%–65% by weight of the whole refiner pulp;
   applying an aqueous solution of sodium sulfite in the range of about 4%–50% sodium sulfite based on bone dry weight of wood, to the long fiber fraction, the solution having a pH in the range of about 4.5–11;
   cooking the sodium sulfite treated long fiber fraction at a temperature in the range of about 100°–160° C. for a period of time in the range of about 2–120 minutes;
   refining the cooked sodium sulfite treated long fiber fraction to provide a refined long fiber fraction that provides handsheets prepared according to TAPPI standard T205 om-81 and, when tested according to TAPPI standard T220 os-71, having a freeness in the range of about 100–300 ml, sheet density in the range of about 0.4–0.55 g/cm$^3$, burst index in the range of about 3.2–4.6 g/cm$^3$, breaking length in the range of about 6500–7800 m and tear index in the range of about 8–14 mN.m$^2$/g;
   recombining at least part of the refined long fiber fraction with at least part of the accept fraction; and
   the combined weight of the accept fraction and the refined long fiber fraction, being at least about 90% based on bone dry weight of wood particles.

2. The method according to claim 1 wherein the aqueous solution of sodium sulfite applied to the wood particles is in the range of about 3%–7% sodium sulfite.

3. The method according to claim 1 wherein the aqueous solution of sodium sulfite applied to the wood particles has a pH in the range of about 5.5–9.5.

4. The method according to claim 1 wherein the sodium sulfite treated wood particles are heated and maintained within the temperature range for a period of time in the range of about 2–4 minutes.

5. The method according to claim 1 wherein the heating of the sodium sulfite treated wood particles occurs at a temperature in the range of about 115°–155° C.

6. The method according to claim 1 wherein the aqueous solution of sodium sulfite applied to the long fiber fraction is in the range of about 8%–18% sodium sulfite.

7. The method according to claim 1 wherein the aqueous solution of sodium sulfite applied to the long fiber fraction has a pH in the range of about 5.5–9.5.

8. The method according to claim 1 wherein the sodium sulfite treated long fiber fraction is cooked for a period of time in the range of about 2–30 minutes.

9. The method according to claim 1 wherein the sodium sulfite treated long fiber fraction is cooked at a temperature in the range of about 130°–155° C.

10. The method according to claim 1 wherein sufficient aqueous solution of sodium sulfite is applied to the wood particles to provide a liquid/wood ratio in the range of about 1/1 to 3/1.

11. A method of improving the properties of mechanical refiner wood pulp, comprising the steps of;
   applying an aqueous solution of sodium sulfite, in the range of about 3%–7% sodium sulfite based on bone dry weight of wood, to wood particles, selected from the group consisting of wood chips, shredded wood chips and shavings, the solution having a pH in the range of about 5.5–9.5;
   heating the sodium sulfite treated wood particles to a temperature in the range of about 115°–155° C. and maintaining the particles in the temperature range for a period of time in the range of about 2–4 minutes;
   refining the heated sodium sulfite treated wood particles into mechanical wood pulp;
   separating the pulp into a long fiber fraction and in accept fraction, the long fiber fraction containing a higher proportion of shives and long fiber material, said long fiber fraction representing about 10%–65% by weight of the whole refiner pulp;
   applying an aqueous solution of sodium sulfite in the range of about 8%–18% sodium sulfite based on bone dry weight of wood, to the long fiber fraction, the solution having a pH in the range of about 5.5–9.5;
   cooking the sodium sulfite treated long fiber fraction at a temperature in the range of about 130°–155° C. for a period of time in the range of about 2–30 minutes;
   refining the cooked sodium sulfite treated long fiber fraction to provide a refined long fiber fraction that provides handsheets prepared according to TAPPI standard T205 om-81 and, when tested according to TAPPI standard T220 os-71, having a freeness in the range of about 100–300 ml, sheet density in the range of about 0.4–0.55 g/cm$^3$, burst index in the range of about 3.2–4.6 g/cm$^3$, breaking length in the range of about 6500–7800 m and tear index in the range of about 8–14 mN.m$^2$/g;
   recombining at least part of the refined long fiber fraction with at least part of the accept fraction; and the combined weight of the accept fraction and the refined long fiber fraction being at least about 90% based on bone dry weight of wood particles.

12. The method according to claim 11 wherein sufficient aqueous solution of sodium sulfite is applied to the wood particles to provide a liquid/wood ratio in the range of about 2/1 to 3/1.

13. The method according to claim 1 or claim 11 wherein the yield of the wood particles after being treated with sodium sulfite and prior to being refined is at least about 91% based on bone dry weight of wood particles.

14. The method according to claim 1 or claim 11 wherein the accept fraction combined with the long fiber fraction is in the range of about 50%–85% by weight of the recombined pulp.

15. The method according to claim 1 or claim 11 wherein the long fiber fraction has a pulp consistency in the range of about 10%–50% prior to application of the aqueous solution of sodium sulfite.

16. The method according to claim 1 or claim 11 wherein the wood particles have a moisture content in the range of about 25%–60%.

17. The method according to claim 1 or claim 11 wherein the wood particles are first squeezed to reduce moisture content in a screw press, followed by application of the aqueous solution of sodium sulfite.

18. The method according to claim 1 or claim 11 wherein the wood particles are first squeezed to reduce moisture content to a range of about 45%–50%, followed by application of the aqueous solution of sodium sulfite.

19. The method according to claim 1 or claim 11 wherein said wood is softwood.

20. The method according to claim 1 or claim 11 wherein the long fiber fraction represents about 10%–35% by weight of the whole mechanical refiner wood pulp.

21. The method according to claim 1 or claim 11 wherein the wood particles are wood chips.

22. The method according to claim 1 or claim 11 wherein the wood particles are shredded wood chips.

23. The method according to claim 1 or claim 11 wherein the wood particles are shavings.

24. The method according to claim 1 or claim 11 wherein sheet density of TAPPI handsheets prepared from the combined fractions is in the range of about 0.375–0.42 g/cm$^3$.

25. The method according to claim 1 wherein sodium sulfite applied to the wood particles is at least 3%.

26. The method according to claim 1 or claim 11 wherein sodium sulfite applied to the wood particles is at least 3% and including application of sodium hydrosulfite to the recombined mechanical refiner wood pulp prior to the pulp being processed into paper.

* * * * *

UNITED STATES PATENT AND TRADEMARK OFFICE

CERTIFICATE OF CORRECTION

PATENT NO. : 4,502,918

DATED : March 5, 1985

INVENTOR(S) : David M. Mackie and Peter Joyce

It is certified that error appears in the above-identified patent and that said Letters Patent is hereby corrected as shown below:

Col. 5, line 38, "3.2-4.6 g/cm3" should read --3.2-4.6 kPa.m2/g--

Col. 13, line 54, "3.2-4.6 g/cm3" should read --3.2-4.6 kPa.m2/g--

Col. 14, line 63, "3.2-4.6 g/cm3" should read --3.2-4.6 kPa.m2/g--

Signed and Sealed this

*Eleventh* Day of *February 1986*

[SEAL]

*Attest:*

DONALD J. QUIGG

*Attesting Officer* *Commissioner of Patents and Trademarks*